US006063556A

United States Patent [19]

Valsecchi et al.

[11] Patent Number: 6,063,556

[45] Date of Patent: May 16, 2000

[54] RADIOGRAPHIC MATERIAL WITH IMPROVED ANTISTATIC PROPERTIES UTILIZING COLLOIDAL VANADIUM OXIDE

[75] Inventors: Alberto Valsecchi, Vado Ligure; Renzo Torterolo, Bragno/Cairo Montenotte, both of Italy

[73] Assignee: Minnesota Mining and Manufacturing Co., St. Paul, Minn.

[21] Appl. No.: 08/330,349

[22] Filed: Oct. 27, 1994

[30] Foreign Application Priority Data

Nov. 29, 1993 [EP] European Pat. Off. ..... 93119175

[51] Int. Cl.[7] ..... G03C 1/85

[52] U.S. Cl. ..... 430/530

[58] Field of Search ..... 430/527, 528, 430/529, 530

[56] References Cited

U.S. PATENT DOCUMENTS

| | | | |
|---|---|---|---|
| 4,203,769 | 5/1980 | Guestaux | 430/631 |
| 4,414,304 | 11/1993 | Dickerson | 430/353 |
| 4,582,782 | 4/1986 | Valsecchi | 430/527 |
| 4,847,189 | 7/1989 | Suzuki et al. | 430/567 |
| 5,006,451 | 4/1991 | Anderson et al. | 430/527 |
| 5,203,884 | 4/1993 | Buchanan et al. | 51/295 |
| 5,204,219 | 4/1993 | Van Ooij et al. | 430/272 |
| 5,221,598 | 6/1993 | Anderson et al. | 430/527 |
| 5,372,985 | 12/1994 | Chang et al. | 503/201 |

FOREIGN PATENT DOCUMENTS

| | | |
|---|---|---|
| 0127820 | 12/1984 | European Pat. Off. . |
| 0238271 | 9/1987 | European Pat. Off. . |
| 0282302 | 9/1988 | European Pat. Off. . |
| 0370404 | 5/1990 | European Pat. Off. . |
| 0486982 | 5/1992 | European Pat. Off. . |
| 2277136 | of 1974 | France . |
| 62-249140 | 10/1987 | Japan . |
| 5-119433 | 5/1993 | Japan . |
| 05281660 | 10/1993 | Japan . |
| 2032405 | 6/1978 | United Kingdom . |

*Primary Examiner*—Christopher G. Young

[57] ABSTRACT

A silver halide radiographic element comprising a polymeric film base, at least one silver halide emulsion layer, and at least one antistatic layer adhered to at least one side of said polymeric film base, wherein (1) said silver halide emulsion layer comprises tabular silver halide grains having an average diameter to thickness ratio of at least 3:1, and (2) said antistatic layer comprises a colloidal vanadium oxide and a sulfopolyester.

32 Claims, No Drawings

RADIOGRAPHIC MATERIAL WITH IMPROVED ANTISTATIC PROPERTIES UTILIZING COLLOIDAL VANADIUM OXIDE

FIELD OF THE INVENTION

The present invention relates to a forehardened silver halide radiographic element comprising (1) silver halide tabular grain emulsion layer(s) and (2) antistatic layer(s) comprising a colloidal vanadium oxide compound and a sulfopolyester compound.

BACKGROUND OF THE ART

Tabular silver halide grains are crystals possessing two major faces that are substantially parallel. The average diameter of said faces is at least three times the distance separating them (the thickness). This is generally described in the art as an aspect ratio of at least 3:1.

Silver halide photographic emulsions containing a high proportion of tabular grains have advantages of good developability, improved covering power and increased useful adsorption of sensitizing dye per weight of silver due to their high surface area-to-volume ratio. The use of such emulsions in photographic elements is disclosed in U.S. Pat. Nos. 4,425,425, 4,425,426, 4,433,048, 4,435,499, 4,439,520, and other related patents.

The use of automatic processors for the rapid processing (i.e., for a processing of from 45 to 90 sec) of light-sensitive silver halide elements including tabular silver halide grains, in particular light-sensitive silver halide elements for radiographic use, is known. Such elements generally include a support (usually provided with a very thin subbing layer) having coated on at least one side thereof a silver halide gelatin emulsion layer coated in turn with a gelatin protective layer. These elements are transported through the machine processing units (developing, fixing, washing and drying) by means of opposed or staggered rollers (as described, for example, in U.S. Pat. No. 3,025,779) which also have the function of squeezing liquid from the film prior to drying. In recent years the increased use of silver halide elements for radiography has led to a strong request for a reduction of processing times. If rapid processing of a film takes place, several problems can occur, such as an inadequate image density (i.e. insufficient sensitivity, contrast and maximum density), insufficient fixing, insufficient washing, and insufficient film drying. Insufficient fixing and washing of a film cause a progressive worsening of the image quality and modification of the silver tone. In order to reduce the time taken by the element to pass through the processing machine from 2 to 0.5 minutes, as particularly required in rapid processing of radiographic elements, the processing is performed at relatively higher temperatures, usually higher than 30° C., preferably between 35–45° C., such as 38° C., and the gelatin content of the silver halide emulsions is considerably reduced as compared to that of emulsions for manual processing.

Under such conditions, even with the changes in the emulsions, the physical and photographic properties of the elements processed in an automatic processor tend to be worse. With high temperatures and in presence of such low gelatin content, for instance, the intrinsic sensitivity to pressure of the silver halide grains gets higher and the elements processed in the automatic processor show marks caused by the pressure of the transporting rollers.

In order to prevent pressure marking, various methods have been described in the art. To this purpose, U.S. Pat. No. 2,960,404 describes the use in the photographic elements of glycerine, ethylene glycol and the like, Japanese Pat. No. 5316/1972 describes the use of 1,4-cyclohexane dimethanol and the like, and Japanese Pat. No. 4939/1978 describes the use of trimethylol propane. Another possible method of preventing pressure marking is by increasing the degree of hardening of the gelatin layers, in particular of the external protective layers. As another method, photographic elements are known wherein an intermediate gelatin layer is interposed between the support and the emulsion layer.

For example, U.S. Pat. No. 3,637,389 describes a rapid processing photographic element wherein gradation, density and sensitivity are improved by applying such an intermediate gelatin layer between the support and the emulsion layer.

However, known methods of preventing pressure marking when used in photographic elements including tabular silver halide grains have proved less effective. In particular, when the hardening degree is increased to achieve a very low swelling index and to improve its resistance to pressure desensitization, photographic characteristics are reduced. Accordingly, the problem still remains of preventing pressure marking in photographic elements including light-sensitive tabular silver halide emulsions.

U.S. Pat. No. 4,414,304 describes forehardened photographic elements, particularly radiographic elements, including at least one hydrophilic colloid emulsion layer containing tabular silver halide grains having an aspect ratio of not lower than 5:1 and a projective area of not lower than 50%. The elements require no additional hardening on development and give images of high covering power. Among gelatin hardeners, bis(vinylsulfonylmethyl) ether, mucochloric acid and formaldehyde are described.

Japanese Pat. Appl. No. J5 9105-636 describes photographic elements comprising at least one silver halide emulsion layer containing tabular silver halide grains, the binder of at least one of the hydrophilic colloidal layers being gelatin which has jelly strength of at least 250 g. Wet coat strength of said elements is improved without reducing covering power.

Japanese Pat. Appl. No. J6 2249-140 describes photographic elements comprising at least one silver halide emulsion layer containing tabular silver halide grains and halogen substituted s-triazine type hardeners. The elements are suitable for rapid processing and have improved pressure resistance.

U.S. Pat. No. 4,847,189 describes a photographic element comprising at least one silver halide emulsion layer containing tabular silver halide grains with an aspect ratio not lower than 5:1 and showing a melting time of from 8 to 45 minutes. The melting time and the gelatin amount of the element renders the element suitable for rapid processing of 45 sec. and improves the pressure desensitization resistance.

EP 238,271 discloses a silver halide photographic element comprising at least one hydrophilic colloidal layer on a support, showing a melting time of from 8 to 45 minutes, and a water content of from 10 to 20 g/m$^2$ upon completion of the washing step. The element is preferably processed in a developing solution comprising indazole and benzotriazole derivatives. The preferred processing time is 45 sec.

U.S. Pat. No. 4,647,528 discloses a method of increasing both covering power and scratch resistance by using a particular polymeric hardener in a photographic element comprising a support coated with least one silver halide emulsion layer containing tabular silver halide grains with an aspect ratio higher than 5:1.

As above mentioned silver halide emulsion layers are coated on a polymeric film support. In particular, photographic elements which require accurate physical characteristics use polyester film bases, such as polyethyleneterephthalate film bases and cellulose ester film bases, such as cellulose triacetate film bases. Silver halide radiographic elements are generally composed of a polyethyleneterephthalate electrically insulating support and silver halide emulsion layers coated thereon. Such a structure promotes the formation and accumulation of static charges when subjecting the radiographic elements to friction or separation, caused by contact with the surface of the same or different elements during steps for manufacturing of the photographic elements or when using them for photographic purposes.

These accumulated static charges cause several drawbacks, which are more evident when the radiographic film is manufactured and/or processed at high speed. The most serious drawback is discharge of accumulated charges prior to development processing, by which the light-sensitive silver halide emulsion layer is exposed to light to form dot spots or branched or feathery linear specks when development of the photographic film is carried out. This is the phenomenon of the so-called "static marks". Such static marks cause a reduction of the commercial value of photographic films, which sometimes become completely useless. For example, the formation of static marks in medical or industrial X-ray films may result in a very dangerous judgment or erroneous diagnosis. Static marks are a particular problem because it becomes evident for the first time by carrying out development. Further, these static charges are also the origin of secondary problems such as adhesion of dusts to the surface of films, uneven coating, and the like.

As mentioned above, such static charge are frequently accumulated when manufacturing and/or processing silver halide photographic elements. For example, during production, they are generated by friction of the photographic film contacting a roller or by separation of the emulsion surface from the support surface during a rolling or unrolling step. Further, they are generated on X-ray films in an automatic apparatus by contact with or separating from mechanical parts or fluorescent screens, or they are generated by contact with or separation from rollers and bars made of rubber, metal, or plastics in a bonding machine or an automatic developing machine or an automatic developing apparatus or in a camera in the case of using color negative films or color reversal films. In addition they can be generated by contacting with packing materials, and the like.

Additionally, photographic elements comprising light-sensitive layers coated onto polymeric film bases, when stored in rolls or reels which are mechanically wound and unwound or in sheets which are conveyed at high speed, tend to accumulate static charges and record the light generated by the static discharges.

Silver halide photographic elements having high sensitivity and handling speed are subject to an increase of static mark appearance. In particular, static marks are easily generated because of high sensitization of the photographic element and severe handling conditions such as high speed coating, high speed exposure, and high speed automatic processing.

Other drawbacks which result from the accumulation of electric charges on polymeric film bases are the adherence of dust and dirt, coating defects and limitation of coating speed.

The static-related damages occur not only before the photographic element has been manufactured, exposed and precessed, but also after processing when the photographic element including the image is used to reproduce and enlarge the image. Accordingly, it is desired to provide permanent antistatic protection which retains its effectiveness even after processing.

In order to prevent problems caused by static charges, it is suitable to add an antistatic agent to the silver halide photographic elements. However, antistatic agent conventionally used in other fields cannot be used freely for silver halide photographic elements, because they are subjected to various specific restrictions due to the nature of the photographic elements. More specifically, the antistatic agents which can be used in silver halide photographic elements must have excellent antistatic abilities while not having adverse influences upon photographic properties of the photographic elements, such as sensitivity, fog, granularity, sharpness. Further, such antistatic agents must not have adverse influences upon the film strength and upon antiadhesion properties. Furthermore, the antistatic agents must not accelerate exhaustion of processing solutions and not deteriorate adhesive strength between layers composing the silver halide photographic element.

In the art of silver halide photographic elements a wide number of solutions to the above described problems have been suggested in patent and literature references, mainly based on charge control agents and electrically conductive compounds coated on the silver halide emulsion layer together with a binder as an antistatic layer.

The most useful charge control agents known in the art are ionic and non-ionic surfactant as well as ionic salts. Fluorinated surfactants are often mentioned as good antistatic agents in silver halide photographic elements.

Electrically conductive compounds are capable of transporting charges away from areas where they are not desired. Typical examples of such electrically conductive substances are polyelectrolites such as the alkali metal salts of polycarboxylic acids or polysulfonic acids, or quaternary ammonium polymers, which dissipate the electrical charge by providing a surface which conducts electrons by an ionic mechanism. However, such compounds are not very suitable in antistatic layers because they lose effectiveness under conditions of low relative humidity, become sticky under conditions of high relative humidity, and lose their antistatic effect after passage through processing baths.

It is known in the art that preferred antistatic materials are those that conduct electrons by a quantum mechanical mechanism rather that an ionic mechanism. This is because antistatic materials that conduct electrons by a quantum mechanical mechanism are effectively independent of humidity. They are suitable for use under conditions of low relative humidity, without losing effectiveness, and under conditions of high relative humidity, without becoming sticky. Defect semiconductor oxides and conductive polymers have been proposed as electronic conductors which operate independent of humidity. A major problem, however, with such electronic conductors is that they generally cannot be provided as thin, transparent, relatively colorless coatings by solution coating methods. The use of vanadium oxide has proved to be the one exception. That is, effective antistatic coatings of vanadium oxide can be deposited in transparent, substantially colorless thin films by coating from aqueous dispersions.

It is known to prepare an antistatic layer from an aqueous composition comprising vanadium oxide as described, for example, in FR Patent Application No. 2,277,136, BE Patent No. 839,270, U.S. Pat. No. 4,203,769 and GB Patent Application No. 2,032,405. The composition comprising the vanadium oxide may contain a binder to improve mechanical properties of an antistatic layer produced therefrom, such as cellulose derivatives, polyvinyl alcohols, polyamides, styrene and maleic anhydride copolymers, copolymer latexes of alkylacrylate, vinylidene chloride and itaconic acid. It is also known to provide such vanadium oxide antistatic layers with a protective overcoat layer that provides abrasion protection and/or enhances frictional characteristics, such as a layer of cellulosic material.

In photographic elements, the antistatic layer comprising vanadium oxide can be located on the side of the film base opposite to the image-forming layer as outermost layer, with or without a protective abrasion-resistant topcoat layer, of can be located as a subbing layer underlying a silver halide emulsion layer or an auxiliary gelatin layer. As vanadium oxide can diffuse from the antistatic layer through the overlying protective layer or gelatin layer into the processing solutions, a diminution or loss of the desired antistatic protection results.

U.S. Pat. No. 5,006,451 describes a photographic element comprising a film base having thereon an antistatic layer comprising vanadium oxide and a barrier layer which overlies the antistatic layer and is comprised of a latex polymer having hydrophilic functionality. This patent reports that said barrier layer prevents the vanadium oxide from diffusing out of the underlying antistatic layer and thereby provides permanent antistatic protection. However, the solution provided by said patent requires a two layer construction which requires additional investment and operating cost, and has been proved by experiments that it looses antistatic protection in processing solutions such as developing and fixing solutions.

Japanese Pat. Appl. No. J05/119433 describes a plastic base film for silver halide photographic material having a layer of polymer binder and vanadium pentoxide coated on at least one side of said plastic base. However, the plastic base is subjected to a tenter treatment after the layer of polymer binder and $V_2O_5$ is coated thereon.

In summary, there is still the need for a silver halide radiographic element which allows a high handling speed, both during manufacturing and processing, without the occurrence of static marks and worsening of physical and photographic properties.

SUMMARY OF THE INVENTION

The present invention relates to a silver halide radiographic element comprising a polymeric film base, at least one silver halide emulsion layer, and at least one antistatic layer adhered to at least one side of said polymeric film base, wherein (1) said silver halide emulsion layer comprises tabular silver halide grains having an average diameter to thickness ratio of at least 3:1, and (2) said antistatic layer comprises a colloidal vanadium oxide and a sulfopolyester.

DETAILED DESCRIPTION OF THE INVENTION

Accordingly, the present invention relates to a silver halide radiographic element comprising a polymeric film base, at least one silver halide emulsion layer, and at least one antistatic layer adhered to at least one side of said polymeric film base, wherein (1) said silver halide emulsion layer comprises tabular silver halide grains having an average diameter to thickness ratio of at least 3:1, and (2) said antistatic layer comprises a colloidal vanadium oxide and a sulfopolyester.

Colloidal vanadium oxide useful in the antistatic layer according to the present invention means a colloidal dispersion in water of single or mixed valence vanadium oxide, wherein the formal oxidation states of vanadium ions are typically +4 and +5. In the art, such species are often referred to as $V_2O_5$. In a preferred embodiment, the ratio of $V^{4+}$ ions to the total concentration of vanadium ions, i.e., $V^{4+}$ and $V^{5+}$ ions, is at least about 0.01:1.0, preferably at least about 0.05:1.0, and more preferably at least about 0.30:1.0. The concentration of $V^{4+}$ in the resultant colloidal dispersion can be determined by titration with permanganate. The colloidal vanadium oxide dispersions are preferably formed by hydrolysis and condensation reactions of vanadium oxide alkoxides. The concentration of $V^{4+}$ in the resultant colloidal dispersion can be easily varied simply by removing volatile reaction products through distillation subsequent to hydrolysis of the vanadium oxoalkoxide. Significantly, the $V^{4+}$ concentration can be varied over a range 1–40% of the total vanadium content. Although not intending to be limited by any theory, it is believed that the concentration of $V^{4+}$ may contribute to the intrinsic conductivity of the coating. Furthermore, it is believed that the $V^{4+}$ ions contribute to the formation of the colloidal dispersion, perhaps acting as polymerization initiators or by controlling interaction. In the aged colloidal form (several hours at 80° C. or more or several days at room temperature), vanadium oxide consists of whisker-shaped or needle-shaped particles of vanadium oxide which preferably have a width in the range of 0.02–0.08 mm and length up to 5 mm. Said vanadium oxide particles show a high aspect ratio, i.e., the ratio of the length to the width of the particles, and are generally evenly distributed. By "high aspect ratio" it is generally meant that the ratio of the length to the width of the particles, as observed in the coating produced from the colloidal dispersion by Field Emission Electron Microscopy, is greater than about 10, preferably grater than 25.

As above mentioned, the colloidal vanadium oxide dispersions are preferably formed by hydrolysis and condensation reactions of vanadium oxide alkoxides. Most preferred colloidal vanadium oxide dispersions are prepared by hydrolyzing vanadium oxoalkoxides with a molar excess of deionized water. In preferred embodiments, the vanadium oxoalkoxides are prepared in situ from a vanadium oxide precursor species and an alcohol. The vanadium oxide precursor species is preferably a vanadium oxyhalide or vanadium oxyacetate. If the vanadium oxoalkoxide is prepared in situ, the vanadium oxoalkoxide may also include other ligands such as acetate groups.

Preferably, the vanadium alkoxide is a trialkoxide of the formula $VO(OR)_3$, wherein each R is independently an aliphatic, aryl, heterocyclic, or arylalkyl group. Preferably, each R is independently selected from the group consisting of C1-10 alkyls, $C_{1-10}$ alkenyls, $C_{1-10}$ alkynyls, $C_{1-18}$ aryls, $C_{1-18}$ arylalkyls, or mixtures thereof, which can be substituted or unsubstituted. "Group" means a chemical species that allows for substitution or which may be substituted by conventional substituents which do not interfere with the desired product. More preferably, each R is independently an unsubstituted $C_{1-6}$ alkyl. When it is said that each R is "independently" selected from a group, it is meant that not all R groups in the formula $VO(RO)_3$ are required to be the same. "Aliphatic" means a saturated or unsaturated linear, branched, or cyclic hydrocarbon or heterocyclic radical. This term is used to encompass alkyls, alkenyls such as vinyl radicals, and alkynyls, for example. The term "alkyl" means a saturated linear, branched, or cyclic hydrocarbon radical. The term "alkenyl" means linear, branched, or cyclic hydrocarbon radical containing at least one carbon-carbon double bond. The term "alkynyl" means a linear or branched hydrocarbon radical containing at least one carbon-carbon triple bond. The term "heterocyclic" means a mono- or polynuclear cyclic radical containing carbon atoms and one or more heteroatoms such as nitrogen, oxygen, sulfur or a combination thereof in the ring or rings, such as furan, thymine, hydantoin, and thiophene. The term "aryl" means a mono- or polynuclear aromatic hydrocarbon radical. The term "arylalkyl" means a linear, branched, or cyclic alkyl hydrocarbon radical having a mono- or polynuclear aromatic hydrocarbon or heterocyclic substituent. The aliphatic, aryl, heterocyclic, and arylalkyl groups can be unsubstituted, or they can be substituted with various groups such as Br, Cl, F, I, OH groups, or other groups which do not interfere with the desired product.

The hydrolysis process results in condensation of the vanadium oxoalkoxides to vanadium oxide colloidal dispersions. It can be carried out in water within a temperature range in which the solvent, which preferably is deionized water or a mixture of deionized water and a water-miscible organic solvent, is in a liquid form, e.g., within a range of about 0–100° C. The process is preferably and advantageously carried out within a temperature range of about 20–30° C., i.e., at about room temperature. The hydrolysis preferably involves the addition of a vanadium oxoalkoxide to deionized water. The deionized water or mixture of deionized water and water-miscible organic solvents may contain an effective amount of a hydroperoxide, such as $H_2O_2$. Preferably, the deionized water and hydroperoxide are combined with a water-miscible organic solvent, such as a low molecular weight ketone or an alcohol. Optionally, the reaction mixture also can be modified by the addition of co-reagents, addition of metal dopants, by subsequent aging or heat treatments, and removal of alcohol by-products. By such modifications the vanadium oxide colloidal dispersion properties can be varied.

The vanadium oxoalkoxides can also be prepared in situ from a vanadium oxide precursor species in aqueous medium and an alcohol. For example, the vanadium oxoalkoxides can be generated in the reaction flask in which the hydrolysis, and subsequent condensation, reactions occur. That is, the vanadium oxoalkoxides can be generated by combining a vanadium oxide precursor species, such as, for example, a vanadium oxyhalide ($VOX_3$), preferably $VOCl_3$, or vanadium oxyacetate ($VO_2OAc$), with an appropriate alcohol, such as i-BuOH, i-PrOH, n-PrOH, n-BuOH, t-BuOH, and the like, wherein Bu=butyl and Pr=propyl. It is understood that if[]vanadium oxoalkoxides are generated in situ, they may be mixed alkoxides. For example, the product of the in situ reaction of vanadium oxyacetate with an alcohol is a mixed alkoxide/acetate. Thus, herein the term "vanadium oxoalkoxide" is used to refer to species that have at least one alkoxide (—OR) group, particularly if prepared in situ. Preferably, the vanadium oxoalkoxides are trialkoxides with three alkoxide groups.

The in situ preparations of the vanadium oxoalkoxides are preferably carried out under an inert atmosphere, such as nitrogen or argon. The vanadium oxide precursor species is typically added to an appropriate alcohol at room temperature. When the reaction is exothermic, it is added at a controlled rate such that the reaction mixture temperature does not greatly exceed room temperature if the reaction is exothermic. The temperature of the reaction mixture can be further controlled by placing the reaction flask in a constant temperature bath, such as an ice water bath. The reaction of the vanadium oxide species and the alcohol can be done in the presence of an oxirane, such as propylene oxide, ethylene oxide, or epichlorohydrine, and the like. The oxirane is effective at removing by-products of the reaction of the vanadium oxide species, particularly vanadium dioxide acetate and vanadium oxyhalides, with alcohols. If desired, volatile starting materials and reaction products can be removed through distillation or evaporative techniques, such as rotary evaporation. The resultant vanadium oxoalkoxide product, whether in the form of a solution or a solid residue after the use of distillation or evaporative techniques, can be added directly to water to produce the vanadium oxide colloidal dispersions for use in the present invention.

The method of producing colloidal vanadium oxide dispersions involves adding a vanadium oxoalkoxide to a molar excess of water, preferably with stirring until a homogeneous colloidal dispersion forms. By a "molar excess" of water, it is meant that a sufficient amount of water is present relative to the amount of vanadium oxoalkoxide such that there is greater that a 1:1 molar ratio of water to vanadium-bound alkoxide. Preferably, a sufficient amount of water is used such that the final colloidal dispersion formed contains less that about 4.5 weight percent and at least a minimum effective amount of vanadium. This typically requires a molar ratio of water to vanadium alkoxide of at least 45:1, and preferably at least about 150:1. Herein, by "minimum effective amount" of vanadium it is meant that colloidal dispersions contain an amount of vanadium in the form of vanadium oxide, whether diluted or not, which is sufficient to form an effective sulfopolyester containing antistatic layer of the present invention.

In preparing preferred embodiments of the vanadium oxide colloidal dispersions, a sufficient amount of water is used such that the colloidal dispersion formed contains about 0.05 weight percent to about 3.5 weight percent vanadium. Most preferably, a sufficient amount of water is used so that the colloidal dispersion formed upon addition of the vanadium-containing species contains about 0.6 weight percent to about 1.7 weight percent vanadium.

In processes for preparing colloidal vanadium oxide dispersions, the vanadium oxoalkoxides are preferably hydrolyzed by adding the vanadium oxoalkoxides to the water, as opposed to adding the water to the vanadium oxoalkoxides. This is advantageous because it typically results in the formation of a desirable colloidal dispersion and generally avoids excessive gelling.

As long as there is a molar excess of water used in the hydrolysis and subsequent condensation reactions of the vanadium oxoalkoxides, water-miscible organic solvents can also be present. That is, in certain preferred embodiments the vanadium oxoalkoxides can be added to a mixture of water and a water-miscible organic solvent. Miscible organic solvents include, but are not limited to, alcohols, low molecular weight ketones, dioxane, and solvents with a high dielectric constant, such as acetonitrile, dimethylformamide, dimethylsulfoxide, and the like. Preferably, the organic solvent is acetone or an alcohol, such as i-BuOH, i-PrOH, n-PrOH, t-BuOH, and the like.

Preferably, the reaction mixture also contains an effective amount of hydroperoxide, such as $H_2O_2$ or t-butyl hydrogen peroxide. The presence of the hydroperoxide appears to improve the dispersing characteristics of the colloidal dispersion and facilitate production of an antistatic coating with highly desirable properties. That is, when an effective amount of hydroperoxide is used the resultant colloidal dispersions are less turbid, and more well dispersed. Preferably, the hydroperoxide is present in amount such that the molar ratio of vanadium oxoalkoxide to hydroperoxide is within a range of about 1:1 to 4:1.

Other methods known for the preparation of vanadium oxide colloidal dispersions, which are less preferred, include inorganic methods such as ion exchange acidification of $NaVO_3$, thermohydrolysis of $VOClO_3$, and reaction of $V_2O_5$ with $H_2O_2$. To provide coatings with effective antistatic properties from dispersions prepared with inorganic precursors typically requires substantial surface concentrations of vanadium, which generally results in the loss of desirable properties such as transparency, adhesion, and uniformity.

The other component of the antistatic layer according to the present invention is a water dispersible sulfopolyester. A wide variety of known water dispersible sulfopolyesters can be used. They include a polyester comprising at least one unit containing a salt of a —$SO_3H$ group, preferably as an alkali metal or ammonium salt. In some instances, these sulfopolyesters are dispersed in water in conjunction with an emulsifying agent and high shear to yield a stable emulsion; sulfopolyesters may also be completely water soluble. Additionally, stable dispersions may be produced in instances where sulfopolyesters are initially dissolved in a mixture of water and an organic co-solvent, with subsequent removal of co-solvent yielding an aqueous sulfopolyester dispersion.

Sulfopolyesters disclosed in U.S. Pat. Nos. 3,734,874, 3,779,993, 4,052,368, 4,104,262, 4,304,901, 4,330,588, for example, relate to low melting (below 100° C.) or non-crystalline sulfopolyester which may be dispersed in water according to methods mentioned above. In general, sulfopolyesters of this type may be best described as polymers containing units (all or some of the units in a copolymer) of the following formula:

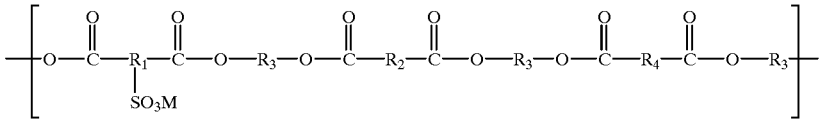

where

M can be an alkali metal cation such as sodium, potassium, or lithium; or suitable tertiary, and quaternary ammonium cations having 0 to 18 carbon atoms, such as ammonium, hydrazonium, N-methyl pyridinium, methylammonium, butylammonium, diethylammonium, triethylammonium, tetraethyl-ammonium, and benzyltrimethylammonium.

R1 can be an arylene group or aliphatic group incorporated in the sulfopolyester by selection of suitable sulfo-substituted dicarboxylic acids such as sulfoalkanedicarboxylic acids including sulfosuccinic acid, 2-sulfoglutaric acid, 3-sulfoglutaric acid, and 2-sulfododecanoic acid; and sulfoarylenedicarboxylic acids such as 5'-sulfoisophthalicd acid, 2-sulfoterephthalic acid, 5-sulfonaphthalene-1,4-dicarboxylic acid; sulfobenzylmalonic acid esters such as those described in U.S. Pat. No. 3,821,281; sulfophenoxymalonate such as described in U.S. Pat. No. 3,624,034; and sulfofluorenedicarboxylic acids such as 9,9-di-(2'-carboxyethyl)-fluorene-2-sulfonic acid. It is to be understood that the corresponding lower alkyl carboxylic esters of 4 to 12 carbon atoms, halides, anhydrides, and sulfo salts of the above sulfonic acids can also be used.

R2 can be optionally incorporated in the sulfopolyester by the selection of one or more suitable arylenedicarboxylic acids, or corresponding acid chlorides, anhydrides, or lower alkyl carboxylic esters of 4 to 12 carbon atoms. Suitable acids include the phthalic acids (orthophthalic, terephthalic, isophthalic), 5-t-butyl isophthalic acid, naphthalic acids (e.g., 1,4- or 2,5-naphthalene dicarboxylic), di-phenic acid, oxydibenzoic acid, anthracene dicarboxylic acids, and the like. Examples of suitable esters or anhydrides include dimethyl isophthalate or dibutyl terephthalate, and phthalic anhydride.

R3 can be incorporated in the sulfopolyester by the selection of one or more suitable diols including straight or branched chain alkylenediols having the formula $HO(CH_2)nOH$ in which n is an integer of 2 to 12 and oxaalkylenediols having the formula $H—(OR_5)m—OH$ in which $R_5$ is an alkylene group having 2 to 4 carbon atoms and m is an integer of 1 to 6, the values being such that there are no more than 10 carbon atoms in the oxaalkylenediol. Examples of suitable diols include ethyleneglycol, propyleneglycol, 1,5-pentanediol, 1,6-hexanediol, 1,8-octanediol, 1,10-decanediol, 2,2-dimethyl-1,3-propanediol, 2,2-diethyl-1,3-propanediol, 3-methyl-1,5-pentanediol, diethyleneglycol, dipropyleneglycol, diisopropyleneglycol, and the like. Also included are suitable cycloaliphatic diols such as 1,4-cyclohexanedimethanol, 1,3-cyclohexanedimethanol, and the like. Suitable polyester or polyether polyols may be used such as polycaprolactone, polyneopentyl adipate, or polyethyleneoxide diols up to 4000 in molecular weight, and the like; generally these polyols are used in conjunction with lower molecular weight diols such as ethylene glycol if high molecular weight polyester are desired.

R4 can be incorporated in the sulfopolyester by the selection of suitable aliphatic or cycloaliphatic dicarboxylic acids or corresponding acid chlorides, anhydrides or ester derivatives; such as acids having the formula $HOOC(CH_2)pCOOH$, wherein p is an integer having an average value of 2 to 8 (e.g., succinic acid, adipic acid, maleic acid, glutaric acid, suberic acid, sebacic acid, and the like). Suitable cycloaliphatic acids include cyclo-hexane-1,4-dicarboxylic acid, and the like.

The sulfopolyesters used in the present invention can be prepared by standard techniques, typically involving the reaction of dicarboxylic acids (or diesters, anhydrides, etc. thereof) with monoalkylene glycols and/or polyols in the presence of acid or metal catalysts (e.g., antimony trioxide, zinc acetate, p-toluene sulfonic acid, etc.), utilizing heat and pressure as desired. Normally, an excess of the glycol is supplied and removed by conventional techniques in the later stages of polymerization. When desired, a hindered phenol antioxidant may be added to the reaction mixture to protect the polyester from oxidation. To ensure that the ultimate polymer will contain more than 90 mole % of the residue of monoalkylene glycols and/or polyols, a small amount of a buffering agent (e.g., sodium acetate, potassium acetate, etc.) is added. While the exact reaction mechanism is not known with certainty, it is thought that the sulfonated aromatic dicarboxylic acid promotes the undesired polymerization of the glycol per se and that this side reaction is inhibited by a buffering agent.

The antistatic layer of the present invention may contain other addenda which do not influence the antistatic properties of the layer, such as, for example, matting agents, plasticizers, lubricants, dyes, and haze reducing agents. In particular, when the antistatic layer must function as both a subbing layer and an antistatic layer underlying an auxiliary gelatin layer or a silver halide emulsion layer, it may be advantageous to add an adhesion promoter to the antistatic layer in order to provide good adhesion of the emulsion layer or the gelatin layer which overlies it.

Preferred adhesion promoters in the antistatic layer of the present invention are epoxy-silane compounds represented by the following general formulae:

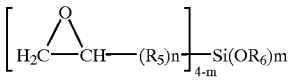

and

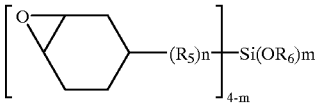

wherein:

$R_5$ is a divalent hydrocarbon radical of less than 20 carbon atoms (the backbone of which is composed only of carbon atoms or of nitrogen, sulfur, silicon and oxygen atoms in addition to carbon atoms with no adjacent heteroatoms within the backbone of said divalent radical except silicon and oxygen), $R_6$ is hydrogen, an aliphatic hydrocarbon radical of less than 10 carbon atoms or an acyl radical of less than 10 carbon atoms, n is 0 or 1, and m is 1 to 3, The most preferred epoxy-silane compounds are those of formulae:

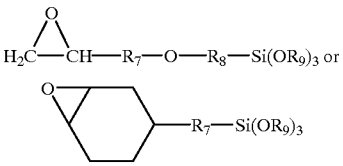

wherein:

$R_7$ and $R_8$ are independently alkylene groups of 1 to 4 carbon atoms, and $R_9$ is hydrogen or an alkyl group of 1 to 10, most preferably 1 to 4 carbon atoms.

Examples of divalent radicals represented by $R_5$ in the above formulae include methylene, ethylene, decalene, phenylene, cyclohexylene, cyclopentene, methylcyclohexylene, 2-ethylbutylene and allene, an ether radical such as:

$—CH_2—CH_2—O—CH_2—CH_2—$,
$—(CH_2—CH_2—O)_2—CH_2—CH_2—$,
$—C_6H_4—O—CH_2—CH_2—$ and
$—CH_2—O—(CH_2)_3—$, or a siloxane radical such as: $—CH_2(CH_3)_2Si—O—$,
$—(CH_2)_2(CH_2)_2Si—O—$, $—(CH_2)_3(CH_3)_2Si—O—$.

Examples of aliphatic hydrocarbon radicals represented by $R_6$ include methyl, ethyl, isopropyl, butyl, and examples of acyl radicals represented by $R_6$ include formyl, acetyl, propionyl.

The epoxy-silane compounds useful in the present invention are preferably γ-glycydoxypropyl-trimethoxy-silane and β-(3,4-epoxycyclo-hexyl)-ethyl-trimethoxy-silane, the most preferred being γ-glycydoxypropyl-trimeth-oxy-silane.

The epoxy-silane compounds described above can be prepared according to methods known in the art, such as for example the methods described in W. Noll, *Chemistry and Technology of Silicones*, Academic Press (1968), pp. 171–3, and in Journal of American Chemical Society, vol. 81 (1959). p. 2632.

Epoxy-silane compounds may be added to the coating solution containing vanadium oxide and sulfopolyester as neat liquids or solids or as solutions in suitable solvents. The epoxy-silane compounds may be hydrolyzed completely or partially before addition. By "partially hydrolyzed" it is meant that not all of the hydrolyzable silicon-alkoxide or silicon-carboxylate groups have been removed from the silane by reaction with water. Hydrolysis of epoxy-silane compounds is conveniently done in the presence of water and a catalyst such as an acid, a base, or fluoride ion. The hydrolyzed epoxy-silane compounds may exist as siloxane polymers or oligomers resulting from condensation of silanol groups produced in the hydrolytic reaction of the epoxy-silane compound with other silanol groups or with unreacted silicon-alkoxide or silicon-carboxylate bonds. It may be desirable add epoxy-silane compounds in the form of co-hydrolysates or co-hydrolysates and co-condensates with other, non-epoxy silane compounds.

The proportions of epoxy-silane compound in the antistatic layer according to this invention can be widely varied to meet the requirements of the particular radiographic element or polymeric film base which is to be provided with an antistatic layer. Typically, the weight ratio of epoxy-silane to sulfopolyester will be in the range of about 0.01 to about 0.6, and preferably of about 0.02 to about 0.4.

Other useful adhesion promoters include non-silane epoxy compounds such as polyethylene glycol diglycidyl ethers, bis-phenol A diepoxide, epoxy containing polymers, epoxy containing polymer latices, and epoxy functional monomers.

The coating composition for preparing the antistatic layer according to this invention can be prepared by dispersing the sulfopolyester in water, optionally with water-miscible solvent (generally less than 50 weight percent cosolvent). The dispersion can contain more than zero and up to 50 percent by weight sulfopolyester, preferably in the range of 10 to 25 weight percent sulfopolyester. Organic solvents miscible with water can be added. Examples of such organic solvents that can be used include acetone, methyl ethyl ketone, methanol, ethanol, and other alcohols and ketones. The presence of such solvents is desirable when need exists to alter the coating characteristics of the coating solution.

For preparation of the mixture of colloidal vanadium oxide and sulfopolyester a most preferred colloidal dispersion of vanadium oxide can be prepared, as noted above, by the hydrolysis of a vanadium oxoalkoxide with a molar excess of deionized water. A preferred preparation is the addition of vanadium iso-butoxide to a hydrogen peroxide solution, as described in detail below. The vanadium oxide dispersion can be diluted with deionized water to a desired concentration before mixing with the aqueous sulfopolyester dispersion. Dispersions containing very small amounts of vanadium oxide can provide useful coating for the present invention. In all cases the amount of vanadium oxide present is sufficient to confer antistatic properties to the final coating. The use of deionized water avoids problems with flocculation of the colloidal particles in the dispersions. Deionized water has had a significant amount of $Ca^{2+}$ and $Mg^{2+}$ ions removed. Preferably, the deionized water contains less than about 50 ppm of these multivalent cations, most preferably less than 5 ppm.

The sulfopolyester dispersion and the vanadium oxide dispersion are mixed together. Generally, this involves stirring the two dispersions together for sufficient time to effect complete mixing. If other materials or particles are to be incorporated into the coating mixture, however, it is frequently more convenient to stir the mixture for several hours by placing the mixture into a glass jar containing several glass beads and roll milling it. Surfactants can be added at the mixing step. Any water compatible surfactant, except those of high acidity or basicity or complexing ability, or which otherwise would interfere with the desired element, is suitable for the practice of this invention. A suitable surfactant does not alter the antistatic characteristics of the coating, but allows for the uniform wetting of a substrate surface by the coating solution. Depending upon the substrate, wetting out completely can be difficult, so it is sometimes convenient to alter the coating composition by the addition of organic solvents. It is apparent to those skilled in the art that the addition of various solvents is acceptable, as long as it does not cause flocculation or precipitation of the sulfopolyester or the vanadium oxide.

Alternatively, the vanadium oxide dispersion can be generated in the presence of a sulfopolyester by, for example, the addition of VO(OiBu)3 (vanadium triisobutoxide oxide) to a dispersion of polymer, optionally containing hydrogen peroxide, and aging this mixture at 50° C. for several hours to several days. In this way, colloidal vanadium oxide dispersions can be prepared in situ with dispersions with which they might otherwise be incompatible, as evidenced by flocculation of the colloidal dispersion. Alternatively, this method simply may be a more convenient preparation method for some dispersions.

The sulfopolyester/vanadium oxide compositions can contain any percent by weight solids. For ease of coatability, these compositions preferably comprise more than zero (as little as about 0.05 weight percent, preferably as little as 0.15 weight percent, solids can be useful) and up to about 15 percent by weight solids. More preferably, the compositions comprise more than zero and up to 10 weight percent solids, and most preferably more than zero and up to 6 weight percent solids. In the dried solids the weight ratio of sulfopolyester to vanadium oxide is preferably higher than 30:1, preferably higher than 100:1, more preferably higher than 200:1. According to a more preferred aspect of the invention the weight ratio of sulfopolyester to vanadium oxide may vary from 100:1 to 1000:1, more preferably from 200:1 to 800:1. Lower values of sulfopolyester/vanadium oxide weight ratios give poor antistatic performances after processing. Higher values of sulfopolyester/vanadium oxide weight ratios give poor antistatic performances even before processing. The amount of vanadium oxide in the radiographic element of the present invention should be at least 0.40 mg/m$^2$, more preferably at least 0.60 mg/m$^2$.

The coatings prepared from the colloidal vanadium oxide/sulfopolyester dispersions of the antistatic layer according to the present invention typically contain whisker shaped colloidal particles of vanadium oxide. These particles can have a high aspect ratio, (i.e., greater than 10 and even as high as 200) and are generally evenly distributed. The colloidal particles were examined by field emission scanning electron microscopy. The micrographs of some samples of vanadium oxide dispersions showed evenly dispersed, whisker-shaped colloidal particles of vanadium oxide, approximately 0.02 to 0.08 mm wide and 1.0 to 5.0 mm long. This invention, however, is not limited to those dimensions of vanadium oxide particles, as one of ordinary skill in the art can readily adjust the synthetic process to alter the dimensions of the particles.

These dispersions can be coated by dip coating, spin coatings, or roll coating. Coatings can also be formed by spray coating, although this is less preferred. The antistatic layer of the present invention can be coated on one side or on both sides of the support base. As the support for the light-sensitive element, there may be used, for example, baryta paper, polyethylene-coated paper, polypropylene synthetic paper, cellulose acetate, polystyrene, a polyester film such as polyethyleneterephthalate, etc. These supports may be chosen depending upon the purpose of use of the light-sensitive silver halide photographic element. The polyester supports are usually subjected to a tenter treatment to improve their mechanical properties. When polyester supports are employed in the present invention, they must be subjected to tenter treatment before the layer of vanadium oxide and polymeric binder is applied thereon. After the layer of vanadium oxide and polymeric binder has been coated on a polyester support, the polyester support must be no more subjected to any tenter treatment. Although not intending to be limited by any theory, it is believed that the intrinsic conductivity of the coating of vanadium oxide is due to the reciprocal contact of the vanadium oxide particles. It has been demonstrated that a tenter treatment of the coated support reduce the conducibility of the antistatic layer, probably due to the separation of the vanadium oxide particles. The supports may be provided with a subbing layer, if necessary. Generally said supports for use in medical radiography are blue tinted. Preferred dyes are anthraquinone dyes, such as those described in U.S. Pat. Nos. 3,488,195; 3,849,139; 3,918,976; 3,933,502; 3,948,664 and in UK Patents 1,250,983 and 1,372,668. Once the dispersion is coated out, the coated film can be dried, generally at a temperature from room temperature up to a temperature limited by film base and sulfopolyester, preferably room temperature to 200° C., most preferably 50 to 150° C., for a few minutes. The dried coating weight preferably can be in the range of 10 mg/m$^2$ to 1 g/m$^2$.

The side of the radiographic element where the silver halide emulsion layer is coated on the antistatic layer of the present invention shows a melting time lower than 20 minutes, preferably lower than 10 minutes, more preferably lower than 5 minutes.

As employed herein the term melting time refers to the time from dipping into an aqueous solution of 1.5% by weight of NaOH at 50° C. a silver halide photographic element cut into a size of 1×2 cm until at least one of the silver halide emulsion layers constituting the silver halide photographic element starts to melt. Reference to this method can also be found in U.S. Pat. No. 4,847,189. It is preferred that the radiographic element of the present invention shows a melting time lower than 20 minutes. In a more preferred embodiment of the present invention, the melting time is lower than 5 minutes.

In the present invention, a silver halide radiographic element showing the above mentioned value of melting time can be processed in a super-rapid processing of less than 45 seconds, preferably of less than 30 seconds from the insertion of the radiographic element in an automatic processor to the exit therefrom, using a hardener free developer and fixer. In these conditions the physical and photographic characteristics of the photographic element of the present invention can be equal to or better than the physical and photographic characteristics obtained with rapid processing of from 45 to 90 seconds.

The radiographic element of the present invention can be forehardened to provide a good resistance in rapid processing conducted in automatic processing machine without the use of hardeners in processing solutions. Examples of gelatin hardeners are aldehyde hardeners, such as formaldehyde, glutaraldehyde, resorcynolaldehyde, and the like, active halogen hardeners, such as 2,4-di-chloro-6-hydroxy-1,3,5-triazine, 2-chloro-4,6-hydroxy-1,3,5-triazine and the like, active vinyl hardeners, such as bis-vinylsulfonyl-methane, 1,2-vinylsulfonyl-ethane, bis-vinyl-sulfonyl-methyl ether, 1,2-bisvinyl-sulfonyl-ethyl ether and the like, N-methylol hardeners, such as dimethylolurea, methyloldimethyl hydantoin and the like, and bi-, tri-, or tetra-vinylsulfonyl substituted organic hydroxy compounds, such as 1,3-bis-vinylsulfonyl-2-propanol and the like. Other references to well known hardeners can be found in *Research Disclosure*, December 1989, Vol. 308, Item 308119, Section X.

The above described gelatin hardeners may be incorporated in the silver halide emulsion layer or in a layer of the silver halide radiographic element having a water-permeable relationship with the silver halide emulsion layer. Preferably, the gelatin hardeners are incorporated in the silver halide emulsion layer.

The amount of the above described gelatin hardener that is used in the silver halide emulsion of the radiographic element of this invention can be widely varied. Generally, the gelatin hardener is used in amounts of from 0.5% to 10% by weight of hydrophilic dispersing agent, such as the above described highly deionized gelatin, although a range of from 1% to 5% by weight of hydrophilic dispersing agent is preferred.

The gelatin hardeners can be added to the silver halide emulsion layer or other components layers of the radiographic element utilizing any of the well-known techniques in emulsion making. For example, they can be dissolved in either water or a water-miscible solvent as methanol, ethanol, etc. and added into the coating composition for the above mentioned silver halide emulsion layer or auxiliary layers.

The tabular silver halide grains contained in the silver halide emulsion layers of this invention have an average diameter to thickness ratio (often referred to in the art as aspect ratio) of at least 3:1, preferably 3:1 to 20:1, more preferably 3:1 to 14:1, and most preferably 3:1 to 8:1. Average diameters of the tabular silver halide grains suitable for use in this invention range from about 0.3 to about 5 mm, preferably 0.5 to 3 mm, more preferably 0.8 to 1.5 mm. The tabular silver halide grains suitable for use in this invention have a thickness of less than 0.4 mm, preferably less than 0.3 mm and more preferably less than 0.2 mm.

The tabular silver halide grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter to thickness ratio of each grain can be calculated, and the diameter to thickness ratios of all tabular grains can be averaged to obtain their average diameter to thickness ratio. By this definition the average diameter to thickness ratio is the average of individual tabular grain diameter to thickness ratios. In practice, it is simpler to obtain an average diameter and an average thickness of the tabular grains and to calculate the average diameter to thickness ratio as the ratio of these two averages. Whatever the used method may be, the average diameter to thickness ratios obtained do not greatly differ.

In the silver halide emulsion layer containing tabular silver halide grains of the invention, at least 15%, preferably at least 25%, and, more preferably, at least 50% of the silver halide grains are tabular grains having an average diameter to thickness ratio of not less than 3:1. Each of the above proportions, "15%", "25%" and "50%" means the proportion of the total projected area of the tabular grains having a diameter to thickness ratio of at least 3:1 and a thickness lower than 0.4 mm, as compared to the projected area of all of the silver halide grains in the layer. Other conventional silver halide grain structures such as cubic, orthorhombic, tetrahedral, etc. may make up the remainder of the grains.

In the present invention, commonly employed halogen compositions of the silver halide grains can be used. Typical silver halides include silver chloride, silver bromide, silver iodide, silver chloroiodide, silver bromoiodide, silver chlorobromoiodide and the like. However, silver bromide and silver bromoiodide are preferred silver halide compositions for tabular silver halide grains with silver bromoiodide compositions containing from 0 to 10 mol% silver iodide, preferably from 0.2 to 5 mol% silver iodide, and more preferably from 0.5 to 1.5% mol silver iodide. The halogen composition of individual grains may be homogeneous or heterogeneous.

Silver halide emulsions containing tabular silver halide grains can be prepared by various processes known for the preparation of photographic elements. Silver halide emulsions can be prepared by the acid process, neutral process or ammonia process. In the stage for the preparation, a soluble silver salt and a halogen salt can be reacted in accordance with the single jet process, double jet process, reverse mixing process or a combination process by adjusting the conditions in the grain formation, such as pH, pAg, temperature, form and scale of the reaction vessel, and the reaction method. A silver halide solvent, such as ammonia, thioethers, thioureas, etc., may be used, if desired, for controlling grain size, form of the grains, particle size distribution of the grains, and the grain-growth rate.

Preparation of silver halide emulsions containing tabular silver halide grains is described, for example, in de Cugnac and Chateau, "Evolution of the Morphology of Silver Bromide Crystals During Physical Ripening", Science and Industries Photographiques, Vol. 33, No.2 (1962), pp.121–125, in Gutoff, "Nucleation and Growth Rates During the Precipitation of Silver Halide Photographic Emulsions", Photographic Science and Engineering, Vol. 14, No. 4 (1970), pp. 248–257,in Berry et al., "Effects of Environment on the Growth of Silver Bromide Microcrystals", Vol.5, No.6 (1961), pp. 332–336, in U.S. Pat. Nos. 4,063,951, 4,067,739, 4,184,878, 4,434,226, 4,414,310, 4,386,156; 4,414,306 and in EP Pat. Appln. No. 263,508.

In preparing the silver halide emulsions containing tabular silver halide grains, a wide variety of hydrophilic dispersing agents for the silver halides can be employed in addition to the highly deionized gelatin. Gelatin as described hereinbefore is preferred, although other colloidal materials such as gelatin derivatives, colloidal albumin, cellulose derivatives or synthetic hydrophilic polymers can be used as known in the art.

The tabular grain silver halide emulsions of the present invention may be sensitized by any procedure known in thephotographic art. Sulfur containing compounds, gold and noble metal compounds, polyoxylakylene compounds are particularly suitable. In particular, the silver halide emulsions may be chemically sensitized with a sulfur sensitizer, such as allyl-thiocarbamide, thiourea, cystine, sodium thiosulfate, arylthiosulfonates, arylsulfinates, allylthiourea, allylthiocyanate, etc.; an active or inert selenium sensitizer;

a reducing sensitizer such as stannous salt, a polyamine, etc.; a noble metal sensitizer, such as gold sensitizer, more specifically potassium aurithiocyanate, potassium chloroaurate, chloroauric acid, gold sulfide, gold selenide, etc.; or a sensitizer of a water soluble salt such as for instance of ruthenium, rhodium, iridium and the like, more specifically, ammonium chloropalladate, potassium chloroplatinate and sodium chloropalladite, etc.; each being employed either alone or in a suitable combination. Other useful examples of chemical sensitizers are described, for example, in Research Disclosure 17643, Section III, 1978 and in Research Disclosure 308119, Section 111, 1989.

Moreover, the silver halide grain emulsion of the present invention may be optically sensitized to a desired region of the visible spectrum. The method for spectral sensitization of the present invention is not particularly limited. For example, optical sensitization may be possible by using an optical sensitizer, including a cyanine dye, a merocyanine dye, complex cyanine and merocyanine dyes, oxonol dyes, hemyoxonol dyes, styryl dyes and streptocyanine dyes, either alone or in combination. Useful optical sensitizers include cyanines derived from quinoline, pyridine, isoquinoline, benzindole, oxazole, thiazole, selenazole, imidazole. Particularly useful optical sensitizers are the dyes of the benzoxazole-, benzimidazole- and benzothiazole-carbocyanine type. Usually, the addition of the spectral sensitizer is performed after the completion of chemical sensitization. Alternatively, spectral sensitization can be performed concurrently with chemical sensitization, can entirely precede chemical sensitization, and can even commence prior to the completion of silver halide precipitation. When the spectral sensitization is performed before the chemical sensitization, it is believed that the preferential absorption of spectral sensitizing dyes on the crystallographic faces of the tabular grains allows chemical sensitization to occur selectively at unlike crystallographic surfaces of the tabular grains. In a preferred embodiment said spectral sensitizers produce J aggregates if adsorbed on the surface of the silver halide grains and a sharp absorption band (J-band) with a bathochromic shifting with respect to the absorption maximum of the free dye in aqueous solution. Spectral sensitizing dyes producing J aggregates are well known in the art, as illustrated by F. M. Hamer, *Cyanine Dyes and Related Compounds*, John Wiley and Sons, 1964, Chapter XVII and by T. H. James, *The Theory of the Photographic Process,* 4th edition, Macmillan, 1977, Chapter 8.

In a preferred form, J-band exhibiting dyes are cyanine dyes. Such dyes comprise two basic heterocyclic nuclei joined by a linkage of methine groups. The heterocyclic nuclei preferably include fused benzene rings to enhance J aggregation. The heterocyclic nuclei are preferably quinolinium, benzoxazolium, benzothiazolium, benzoselenazolium, benzimidazolium, naphthoxazolium, naphthothiazolium and naphthoselenazolium quaternary salts.

To the above emulsion may also be added various additives conveniently used depending upon their purpose. These additives include, for example, stabilizers or antifoggants such as azaindenes, triazoles, tetrazoles, imidazolium salts, polyhydroxy compounds and others; developing promoters such as benzyl alcohol, polyoxyethylene type compounds, etc.; image stabilizers such as compounds of the chromane, cumaran, bisphenol type, etc.; and lubricants such as wax, higher fatty acids glycerides, higher alcohol esters of higher fatty acids, etc. Also, coating aids, modifiers of the permeability in the processing liquids, defoaming agents, antistatic agents and matting agents may be used. Other useful additives are disclosed in Research Disclosure, Item 17643, December 1978 in Research Disclosure, Item 18431, August 1979 and in Research Disclosure 308119, Section IV, 1989.

As a binder for silver halide emulsions and other hydrophilic colloid layers, gelatin is preferred, but other hydrophilic colloids can be used, alone or in combination, such as, for example, dextran, cellulose derivatives (e.g., hydroxyethylcellulose, carboxymethyl cellulose), collagen derivatives, colloidal albumin or casein, polysaccharides, synthetic hydrophilic polymers (e.g., polyvinylpyrrolidone, polyacrylamide, polyvinylalcohol, polyvinylpyrazole) and the like. Gelatin derivatives, such as, for example, highly deionized gelatin, acetylated gelatin and phthalated gelatin can also be used. It is also common to employ said hydrophilic colloids in combination with synthetic polymeric binders and peptizers such as acrylamide and methacrylamide polymers, polymers of alkyl and sulfoalkyl acrylates and methacrylates, polyvinyl alcohol and its derivatives, polyvinyl lactams, polyamides, polyamines, polyvinyl acetates, and the like. Highly deionized gelatin is characterized by a higher deionization with respect to the commonly used photographic gelatins. Preferably, highly deionized gelatin is almost completely deionized which is defined as meaning that it presents less than 50 ppm (parts per million) of $Ca^{++}$ ions and is practically free (less than 5 parts per million) of other ions such as chlorides, phosphates, sulfates and nitrates, compared with commonly used photographic gelatins having up to 5,000 ppm of $Ca^{++}$ ions and the significant presence of other ions.

Other layers and additives, such as subbing layers, surfactants, filter dyes, intermediate layers, protective layers, anti-halation layers, barrier layers, development inhibiting compounds, speed-increasing agent, stabilizers, plasticizer, chemical sensitizer, UV absorbers and the like can be present in the radiographic element.

A detailed description of photographic elements and of various layers and additives can be found in Research Disclosure 17643 December 1978, 18431 August 1979, 18716 November 1979, 22534 January 1983, and 308119 December 1989.

The silver halide radiographic element of the present invention can be exposed and processed by any conventional processing technique. Any known developing agent can be used into the developer, such as, for example, dihydroxybenzenes (e.g., hydroquinone), pyrazolidones (1-phenyl-3-pyrazolidone-4,4-dimethyl-1-phenyl-3-pyrazolidone), and aminophenols (e.g., N-methyl-p-aminophenol), alone or in combinations thereof. Preferably the silver halide radiographic elements are developed in a developer comprising dihydroxy-benzenes as the main developing agent, and pyrazolidones and p-aminophenols as auxiliary developing agents. More preferably, the silver halide radiographic elements of the present invention are developed in a hardener free developer solution.

Other well known additives can be present in the developer, such as, for example, antifoggants (e.g., benzotriazoles, indazoles, tetrazoles), silver halide solvents (e.g., thiosulfates, thiocyanates), sequestering agents (e.g., amino-polycarboxylic acids, aminopolyphosphonic acids), sulfite antioxidants, buffers, restrainers, hardeners, contrast promoting agents, surfactants, and the like. Inorganic alkaline agents, such as KOH, NaOH, and LiOH are added to the developer composition to obtain the desired pH which is usually higher than 10.

The silver halide radiographic element of the present invention can be processed with a fixer of typical composition. The fixing agents include thiosulfates, thiocyanates, sulfites, ammonium salts, and the like. The fixer composition can comprise other well known additives, such as, for example, acid compounds (e.g., metabisulfates), buffers (e.g., carbonic acid, acetic acid), hardeners (e.g., aluminum salts), tone improving agents, and the like.

The present invention is particularly intended and effective for high temperature, accelerated processing with automatic processors where the radiographic element is transported automatically and at constant speed from one processing unit to another by means of roller. Typical examples of said automatic processors are 3M TRIMATIC™ XP515 and KODAK RP X-OMAT™. The processing temperature ranges from 20° to 60° C., preferably from 30° to 50° C. and the processing time is lower than 60 seconds, preferably lower than 45 seconds, more preferably lower than 30 seconds. The good antistatic and surface characteristics of the silver halide radiographic element of the present invention allow the rapid processing of the element without having the undesirable appearance of static marks or scratches on the surface of the film.

Objects and advantages of this invention are further illustrated by the following examples, but the particular materials and amounts thereof recited in these examples, as well as other conditions and details, should not be construed to unduly limit this invention.

EXAMPLE 1

Preparation of the Tabular Grain Silver Halide Emulsion

A tabular grain silver bromide emulsion (having an average diameter to thickness ratio of 8:1, prepared in the presence of a deionized gelatin having a viscosity at 60° C. in water at 6.67% w/w of 4.6 mPas, a conducibility at 40° C. in water at 6.67% w/w of less than 150 μs/cm and less than 50 ppm of $Ca^{++}$) was optically sensitized to green light with a cyanine dye and chemically sensitized with gold isocyanate complex, sodium p-toluenthiosulfonate, sodium p-toluensulfinate and benzo-thiazoleiodoethylate. At the end of the chemical digestion, non-deionized gelatin (having a viscosity at 60° C. in water at 6.67% w/w of 5.5 mPas, a conducibility at 40° C. in water at 6.67% w/w of 1,100 μs/cm and 4,500 ppm of $Ca^{++}$) was added to the emulsion in an amount to have 83% by weight of deionized gelatin and 17% by weight of non-deionized gelatin. The emulsion was added with a 5-methyl-7-hydroxy-triazaindolizine stabilizer, an anionic surfactant, and a hardener mixture (dimethylolurea and resorcynolaldehyde).

Preparation of Vanadium Oxide

Vanadium oxide colloidal dispersion was prepared by adding vanadium triisobutoxide ($VO(O\text{-}iBu)_3$) (15.8 g, 0.055 moles, Akzo Chemicals, Inc., Chicago, Ill.) to a rapidly stirring solution of hydrogen peroxide (1.56 g of a 305 aqueous solution, 0.0138 moles, Mallinckrodt, Paris, Ky.) in deionized water (232.8 g) at room temperature giving a solution with vanadium concentration equal to 0.22 moles/kg (2.0% $V_2O_5$). Upon addition of the vanadium isobutoxide, the mixture became dark brown and gelled within five minutes. With continuos stirring, the dark brown gel broke up giving an inhomogeneous, viscous dark brown solution which was homogeneous in about 45 minutes. The sample was allowed to stir for 1.5 hours at room temperature. It was then transferred to a polyethylene bottle and aged in a constant temperature bath at 50° C. for 6 days to give a dark brown thixotropic colloidal dispersion.

The concentration of $V^{(+4)}$ in the gel was determined by titration with potassium permanganate to be 0.072 moles/kg. This corresponded to a mole fraction of $V^{(+4)}$[i.e., $V^{(+4)}$/total vanadium] of 0.33.

The colloidal dispersion was then further mixed with deionized water to form desired concentrations before use in coating formulations.

Preparation of Sulfopolyester

Synthesis of Sulfopolyester (Polymer A)

A one gallon polyester kettle was charged with 126 g (6.2 mole %) dimethyl 5-sodiosulfoisophthalate, 625.5 g (46.8 mole %) dimethyl terephthalate, 628.3 g (47.0 mole %) dimethyl isophthalate, 854.4 g (200 mole % glycol excess) ethylene glycol, 365.2 g (10 mole %, 22 weight % in final polyester) PCP-0200™ polycaprolactone diol (Union Carbide, Danbury, Conn.), 0.7 g antimony oxide, and 2.5 g sodium acetate. The mixture was heated with stirring to 180° C. at 138 kPa (20 psi) under nitrogen, it which time 0.7 g of zinc acetate was added. Methanol evolution was observed. The temperature was increased to 220° C. and held for 1 hour. The pressure was then reduced, vacuum applied (0.2 torr), and the temperature increased to 260° C. The viscosity of the material increased over a period of 30 minutes, after which time a high molecular weight, clear, viscous sulfopolyester was drained. This sulfopolyester was found by DSC to have a Tg of 41.9° C. The theoretical sulfonate equivalent weight was 3954 g polymer per mole of sulfonate. 500 g of the polymer were dissolved in a mixture of 2000 g water and 450 g isopropanol at 80° C. The temperature was then raised to 95° C. in order to remove the isopropanol (and a portion of water), yielding a 21% solids aqueous dispersion.

Synthesis of Sulfopolyester (Polymer B)

A 1000 ml three-necked round bottom flask equipped with a sealed stirrer, thermometer, reflux condenser and means for reducing pressure was charged with 134.03 g dimethyl terephthalate (65 mole percent)

47.16 g dimethyl sodium sulfoisophthalate (15 mole percent)

36.99 9 dimethyl adipate (20 mole percent)

131.79 g ethylene glycol (100 mole percent)

0.11 g antimony trioxide, and 0.94 g sodium acetate.

The mixture was stirred and heated to 155° C. and maintained at 155° C. to 180° C. for about 2 hours while methanol distilled. When the temperature reached 180° C., 0.5 g zinc acetate (an esterification catalyst) was added. The temperature was slowly increased to 230° C. over a period of 5 hours, during which time methanol evolution was completed. The pressure in the flask was reduced to 0.5 Torr or lower, whereupon ethylene glycol distilled, about 60 g being collected. The temperature was then increased to 250° C. where it was held for 1.5 hours after which the system was brought to atmospheric pressure with dry nitrogen and the reaction product was drained from the flask into a polytetrafluoroethylene pan and allowed to cool. The resulting polyester had a $T_g$ by DSC of 45° C. and a (melting point) Tm of 170° C. The sulfopolyester had a theoretical sulfonate equivalent weight of 1350, and was soluble in hot (80° C.) water.

Preparation of Coating Mixtures

General Procedure

The vanadium oxide colloidal dispersion was diluted to desired concentration by mixing with deionized water. This solution was mixed with an aqueous dispersion of the sulfopolyester and a small amount of a surfactant. Addition of surfactant was preferred to improve the wetting properties of the coating. Adhesion promoters were added to the antistatic composition to improve the adhesion of the antistatic layer to the support base and the adhesion of the emulsion layer to the antistatic layer. In Table 1 are summarized the kind of adhesion promoter employed in an amount of about 10–30% by weight of total solid. The mixture was coated with double roller coating on one side of a blue polyester film substrate such as polyethyleneterephthalate to perform static decay and surface resistivity measurements. It was found possible to coat the antistatic composition onto the film substrate as such without employing film treatments (e.g., flame treatment, corona treatment, plasma treatment) or additional layers (e.g., primers, subbings). The above described tabular grain silver halide emulsion was coated on each side of the polyester support at a silver coverage of 2.15 g/m$^2$ and a gelatin coverage of 1.5 g/m$^2$ per side. A low-viscosity gelatin protective supercoat containing 1.1 g/m$^2$ of gelatin per side, Niaproof™ (the trade name of an anionic surfactant of the alkane sulfate type), a tegobetaine surfactant, a fluorinated surfactant having the following formula:

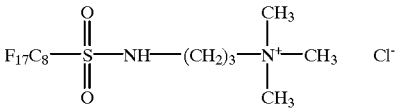

a silicone dispersion, and a polymethylmethacrylate matting agent was applied on each coating so obtaining thirteen different double-side radiographic films 1 to 13.

The coated articles were dried at 60° C. for 2 minutes. The antistatic properties of the coated films were measured by determining the surface resistivity and the charge decay time of each coated sample. Surface resistivity measurements were made using the following procedure: samples of each film were kept in a cell at 21° C. and 25% R.H. for 24 hours and the electrical resistivity was measured by means of a Hewlett-Packard High resistance Meter model 4329A. Values of resistivity of less than $5\times10^{11}$ are optimum. Values up to $1\times10^{12}$ can be useful. The following table 1 also reports four adhesion values: the first is the dry adhesion value and refers to the adhesion of the silver halide emulsion layers and of the auxiliary gelatin layers to the antistatic layer prior to the photographic processing; the second and the third adhesion values are the wet adhesion values and refer to the adhesion of the above layers to the antistatic layer during the photographic processing (developer and fixer); the fourth adhesion value is the dry adhesion value and refers to the adhesion of the above layers to the antistatic layer after photographic processing. In particular, the dry adhesion was measured by tearing samples of the coated film, applying a 3M Scotch™ brand 5959 Pressure sensitive Tape along the tear line of the film and separating rapidly the tape from the film: the layer adhesion was evaluated according a scholastic method giving a value 0 when the whole layer was removed from the base and a value of 10 when no part thereof was removed from the base and intermediate values for intermediate situations. The wet adhesion was measured by drawing some lines with a pencil point to form an asterisk on the film just taken out from the processing bath and by rubbing on the lines with a finger. Also in this case, the adhesion of the layers was measured according a scholastic method by giving a value of 0 when the layers were totally removed from the base, a value of 10 when no portion thereof was removed and intermediate values for intermediate cases. The results are summarized in the following Table 1.

TABLE 1

| Adhesion promoter | Resistivity (Ohm) | Adhesion of the overcoated layer Dry | Developer | Fixer | Dry |
|---|---|---|---|---|---|
| Gelatine | $8\times10^{12}$ | 2 | 1 | 1 | 0 |
| Gelatine + dimethylolurea and resorcynaldehyde | $1\times10^{14}$ | 5 | 2 | 2 | 5 |
| Ethylenglycoldiglycidyl ether | $7\times10^{14}$ | 10 | 1 | 1 | 0 |
| Polyvinyl alcohol | $7\times10^{10}$ | 3 | 0 | 0 | 0 |
| Polyvinylacetate | $3\times10^{11}$ | 10 | 4 | 4 | 10 |
| Polyvinylether | $7\times10^{11}$ | 10 | 0 | 0 | 0 |
| Hydroxymethylcellulose | $3\times10^{10}$ | 2 | 0 | 0 | 0 |
| Hydroxypropylcellulose | $1.5\times10^{10}$ | 10 | 0 | 0 | 0 |
| Carboxymethylcellulose | $3.5\times10^{10}$ | 10 | 0 | 0 | 0 |
| Tetramethoxysilane | $3.5\times10^{10}$ | 10 | 0 | 0 | 0 |
| γ-Methacryloxypropyltrimethoxysilane | $2\times10^{10}$ | 2 | 0 | 0 | 0 |
| γ-Glycidoxypropyltrimethoxysilane | $5.5\times10^{10}$ | 8 | 10 | 10 | 10 |

The best results, in terms of both antistatic and adherence properties, are show by the sample containing γ-glycidoxypropyltrimethoxysilane. This is probably due to the presence of an epoxy group.

EXAMPLE 2

An aqueous antistatic formulation comprising 0.15 g/l vanadium oxide prepared as described above, 5.7 g/l of the sulfopolyester Polymer A described above, 0.3 g/l of γ-glycydoxypropyltrimethoxysilane, 0.2 g/l Triton X-100, was coated with double roller coating on one side of an untreated polyethylene terephthalate blue film base at a coverage of 10 ml/m$^2$ and dried at 60° C. for 2 minutes to obtain an antistatic support (Support 1).

An aqueous antistatic formulation comprising 0.10 g/l vanadium oxide prepared as described above, 5.7 g/l of the sulfopolyester Polymer A described above, 0.3 g/l of γ-glycydoxypropyltrimethoxysilane, 0.2 g/l Triton X-100, was coated with double roller coating on one side of an untreated polyethylene terephthalate blue film base at a coverage of 10 ml/m$^2$ and dried at 60° C. for 2 minutes to obtain an antistatic support (Support 2).

An aqueous antistatic formulation comprising 0.05 g/l vanadium oxide prepared as described above, 5.7 g/l of the sulfopolyester Polymer A described above, 0.3 g/l of γ-glycydoxypropyltrimethoxysilane, 0.2 g/l Triton X-100, was coated with double roller coating on one side of an untreated polyethylene terephthalate blue film base at a coverage of 10 ml/m$^2$ and dried at 60° C. for 2 minutes to obtain an antistatic support (Support 3).

An aqueous antistatic formulation comprising 0.15 g/l vanadium oxide prepared as described above, 18 g/l of the sulfopolyester Polymer A described above, 0.3 g/l of γ-glycydoxypropyltrimethoxysilane, 0.2 g/l Triton X-100, was coated with double roller coating on one side of an untreated polyethylene terephthalate blue film base at a coverage of 10 ml/m$^2$ and dried at 60° C. for 2 minutes to obtain an antistatic support (Support 4).

An aqueous antistatic formulation comprising 0.15 g/l vanadium oxide prepared as described above, 5.7 g/l of the sulfopolyester Polymer A described above, 0.1 g/l of γ-glycydoxypropyltrimethoxysilane, 0.2 g/l Triton X-100, was coated with double roller coating on one side of an untreated polyethylene terephthalate blue film base at a coverage of 10 ml/m$^2$ and dried at 60° C. for 2 minutes to obtain an antistatic support (Support 5).

An aqueous antistatic formulation comprising 0.15 g/l vanadium oxide prepared as described above, 5.7 g/l of the sulfopolyester Polymer A described above, 0.05 g/l of γ-glycydoxypropyltrimethoxysilane, 0.2 g/l Triton X-100, was coated with double roller coating on one side of an untreated polyethylene terephthalate blue film base at a coverage of 10 ml/m$^2$ and dried at 60° C. for 2 minutes to obtain an antistatic support (Support 6).

An aqueous antistatic formulation comprising 0.015 g/l vanadium oxide prepared as described above, 5.7 g/l of the sulfopolyester Polymer A described above, 0.2 g/l Triton X-100, was coated with double roller coating on one side of an untreated polyethylene terephthalate blue film base at a coverage of 10 ml/m$^2$ and dried at 60° C. for 2 minutes to obtain an antistatic support (Support 7). γ-glycydoxypropyltrimethoxysilane was absent.

An aqueous antistatic formulation comprising 0.05 g/l vanadium oxide prepared as described above, 5.7 g/l of the sulfopolyester Polymer A described above, 0.05 g/l of γ-glycydoxypropyltrimethoxysilane, 0.2 g/l Triton X-100, was coated with double roller coating on one side of an untreated polyethylene terephthalate blue film base at a coverage of 10 ml/m$^2$ and dried at 60° C. for 2 minutes to obtain an antistatic support (Support 8).

The above described tabular grain emulsion was divided into eight portions and coated on each side of the above described blue polyester film supports 1 to 8 at a silver coverage of 2 g/m$^2$ and a gelatin coverage of 1.6 g/m$^2$ per side. The above described low-viscosity gelatin protective supercoat containing 1.1 g/m$^2$ of gelatin per side was overcoated, so obtaining eight radiographic films 1 to 8.

A reference radiographic film 9 was obtained by coating the above mentioned tabular grain emulsion on each side of an untreated blue polyester support at a silver coverage of 2 g/m$^2$ and a gelatine coverage of 1.6 g/m$^2$. A conventional antistatic layer comprising 50 mg/m$^2$ of Niaproof™, 21 mg/m$^2$ of Tegobetaine™, 1.8 mg/m$^2$ of a fluorinated surfactant and 35 mg/m$^2$ of a silicone dispersion was coated over each side of the radiographic film.

After conditioning the samples were exposed and developed. After that they were evaluated according to the "Charge Decay Time Test" and the "Surface Resistivity Test".

Charge Decay Time Test

According to this test the static charge dissipation of each of the films was measured. The films were cut into 45×54mm samples and conditioned at 25% relative humidity and T=21° C. for 15 hours. The charge decay time was measured with a Charge Decay Test Unit JCl 155 (manufactured by John Chubb Ltd., London). This apparatus deposits a charge on the surface of the film by a high voltage corona discharge and a fieldmeter allows observation of the decay time of the surface voltage. The lower the time, the better the antistatic properties of the film. To prevent the charge decay behavior of the tested surface from being influenced by the opposite surface, this surface was grounded by contacting it with a metallic back surface.

Surface Resistivity Test

According to this test the resistivity of the sample surface was measured using the Hewlett Packard model 4329A high resistance meter.

The results of the above mentioned tests, together with the sensitometric results, are summarized in the following table 2.

TABLE 2

| | Decay Time (sec) | | Surface Resist. | | | | Hardness (Dornberg Degree) | | Melting Time (min) | |
|---|---|---|---|---|---|---|---|---|---|---|
| Sample | A.S. | O.S. | (Ohm) | D.min | D.max | Speed | A.S. | O.S. | A.S. | O.S. |
| 1 | 0 | 233 | $4.7 \times 10^9$ | 0.22 | 4.30 | 2.06 | 42 | 45 | 1 | 14 |
| 2 | 0 | 222 | $6.7 \times 10^9$ | 0.20 | 3.87 | 2.07 | 36 | 40 | / | / |
| 3 | 0 | 200 | $4.5 \times 10^{10}$ | 0.20 | 4.01 | 2.08 | 31 | 41 | 1 | 14 |
| 4 | 0 | 232 | $2.4 \times 10^9$ | 0.205 | 3.89 | 2.07 | 48 | 40 | / | / |
| 5 | 0 | 200 | $3.7 \times 10^9$ | 0.20 | 3.87 | 2.07 | 45 | 45 | / | / |
| 6 | 0 | 190 | $6.0 \times 10^9$ | 0.20 | 3.92 | 2.07 | 40 | 42 | / | / |
| 7 | 0 | 180 | $3.3 \times 10^9$ | 0.17 | 4.50 | 1.80 | / | 52 | / | / |
| 8 | 0 | 206 | $2.2 \times 10^9$ | 0.20 | 3.87 | 2.08 | 38 | 44 | / | / |
| 9 | 254 | | $2.2 \times 10^{13}$ | 0.20 | 3.81 | 2.09 | 33 | | 14 | |

A.S. = Antistatic Side
O.S. = Other Side

Table 2 clearly shows that all the samples 1 to 8 of the present invention have better antistatic results than the reference sample 9. The sensitometric properties are also substantially equivalent. The absence of static charge on the radiographic film provided with the antistatic layer of the present invention allows a rapid handling both during manufacturing and during further processing of the image-wise exposed film. Both samples 1 and 8, containing the highest and the lowest amount of vanadium pentoxide and γ-glycydoxypropyltrimethoxysilane are suitable for a rapid processing (from developing to dry) of lower than 45 seconds. The sensitometric and physical results of the film samples of the present invention after such a rapid processing remain unchanged, without the appearance of static marks, even in conditions of high relative humidity. The melting time of the side comprising the antistatic layer of the present invention is substantially lower than the melting time of the reference sample, but the hardness of all films is comparable and suitable for a development processing free of hardener.

EXAMPLE 3

An aqueous antistatic formulation comprising 0.05 g/l vanadium oxide prepared as described above, 6 g/l of the sulfopolyester Polymer A described above, 0.06 g/l of γ-glycydoxypropyltrimethoxysilane, 0.2 g/l Triton X-100, was coated with double roller coating on one side of an untreated polyethylene terephthalate blue film base at a coverage of 10 ml/m$^2$ and dried at 60° C. for 2 minutes to obtain an antistatic support (Support 10). The vanadium oxide to sulfopolyester weight ratio was 1:120.

An aqueous antistatic formulation comprising 0.05 g/l vanadium oxide prepared as described above, 6 g/l of the sulfopolyester Polymer A described above, 0.06 g/l of γ-glycydoxypropyltrimethoxysilane, 0.6 g/l Triton X-200, was coated with double roller coating on one side of an untreated polyethylene terephthalate blue film base at a coverage of 10 ml/m$^2$ and dried at 60° C. for 2 minutes to obtain an antistatic support (Support 11). The vanadium oxide to sulfopolyester weight ratio was 1:120.

An aqueous antistatic formulation comprising 0.05 g/l vanadium oxide prepared as described above, 20 g/l of the sulfopolyester Polymer A described above, 0.07 g/l of γ-glycydoxypropyltrimethoxysilane, 0.2 g/l Triton X-100, was coated with double roller coating on one side of an untreated polyethylene terephthalate blue film base at a coverage of 10 ml/m$^2$ and dried at 60° C. for 2 minutes to obtain an antistatic support (Support 12). The vanadium oxide to sulfopolyester weight ratio was 1:400.

An aqueous antistatic formulation comprising 0.025 g/l vanadium oxide prepared as described above, 10 g/l of the sulfopolyester Polymer A described above, 0.03 g/l of γ-glycydoxypropyltrimethoxysilane, 0.2 g/l Triton X-100, was coated with double roller coating on one side of an untreated polyethylene terephthalate blue film base at a coverage of 10 ml/m$^2$ and dried at 60° C. for 2 minutes to obtain an antistatic support (Support 13). The vanadium oxide to sulfopolyester weight ratio was 1:400.

An aqueous antistatic formulation comprising 0.025 g/l vanadium oxide prepared as described above, 15 g/l of the sulfopolyester Polymer A described above, 0.05 g/l of γ-glycydoxypropyltrimethoxysilane, 0.2 g/l Triton X-100, was coated with double roller coating on one side of an untreated polyethylene terephthalate blue film base at a coverage of 10 ml/m$^2$ and dried at 60° C. for 2 minutes to obtain an antistatic support (Support 14). The vanadium oxide to sulfopolyester weight ratio was 1:600.

An aqueous antistatic formulation comprising 0.025 g/l vanadium oxide prepared as described above, 20 g/l of the sulfopolyester Polymer A described above, 0.07 g/l of γ-glycydoxypropyltrimethoxysilane, 0.2 g/l Triton X-100, was coated with double roller coating on one side of an untreated polyethylene terephthalate blue film base at a coverage of 10 ml/m$^2$ and dried at 60° C. for 2 minutes to obtain an antistatic support (Support 15). The vanadium oxide to sulfopolyester weight ratio was 1:800.

An aqueous antistatic formulation comprising 0.005 g/l vanadium oxide prepared as described above, 4 g/l of the sulfopolyester Polymer A described above, 0.013 g/l of γ-glycydoxypropyltrimethoxysilane, 0.2 g/l Triton X-100, was coated with double roller coating on one side of an untreated polyethylene terephthalate blue film base at a coverage of 10 ml/m$^2$ and dried at 60° C. for 2 minutes to obtain an antistatic support (Support 16). The vanadium oxide to sulfopolyester weight ratio was 1:120. The vanadium oxide to sulfopolyester weight ratio was 1:800.

The above described tabular grain emulsion was divided into eight portions and coated on the above described blue polyester film supports 10 to 16 at a silver coverage of 2 g/m$^2$ and a gelatin coverage of 1.6 g/m$^2$ per side. The above described low-viscosity gelatin protective supercoat containing 1.1 g/m$^2$ of gelatin per side was overcoated, so obtaining eight radiographic films 10 to 16.

A reference radiographic film 17 was obtained by coating the above mentioned tabular grain emulsion on an untreated blue polyester support at a silver coverage of 2 g/m$^2$ and a gelatine coverage of 1.6 g/m$^2$. A conventional antistatic layer comprising 50 mg/m$^2$ of Niaproof™, 21 mg/m$^2$ of Tegobetaine™, 1.8 mg/m$^2$ of a fluorinated surfactant and 35 mg/m$^2$ of a silicone dispersion was coated over each side of the radiographic film.

After conditioning the samples were exposed and developed. After that they were evaluated according to the above mentioned "Charge Decay Time Test" and the "Surface Resistivity Test".

The results of the above mentioned tests, together with the sensitometric results, are summarized in the following table 3.

TABLE 3

| Sample | Decay Time (sec.) | Surface Resistivity (Ohm) | $V_2O_5$/SPE Weight Ratio | $V_2O_5$ mg/m$^2$ |
|---|---|---|---|---|
| 10 | 3 | $1.5 \times 10^{11}$ | 1:120 | 0.75 |
| 11 | 0 | $3.1 \times 10^{10}$ | 1:120 | 0.75 |
| 12 | 4 | $1.7 \times 10^{10}$ | 1:400 | 0.90 |
| 13 | 230 | $1.0 \times 10^{13}$ | 1:400 | 0.37 |
| 14 | 7 | $6.2 \times 10^{11}$ | 1:600 | 0.45 |
| 15 | 2 | $3.0 \times 10^{11}$ | 1:800 | 0.45 |
| 16 | 270 | $1.3 \times 10^{13}$ | 1:800 | 0.075 |
| 17 | 300 | $3.0 \times 10^{13}$ | / | / |

Note: SPE = Sulfopolyester

The results of Table 3 clearly shows that there is a critical amount of $V_2O_5$. When the amount of $V_2O_5$ in the coated radiographic element is lower the 0.40. the benefits of the present invention were lost. On the other hand Table 3 clearly shows that the reduction of the $V_2O_5$ to sulfopolyester weight ratio improves the results of the present invention. The comparison of samples 10 and 14 with samples 12 and 15, respectively, is particularly significant. The reduction of the $V_2O_5$ to sulfopolyester weight ratio when employing about the same amount of $V_2O_5$ can improve the antistatic characteristics of the radiographic element.

We claim:

1. A silver halide radiographic element comprising a polymeric film base, at least one gelatin silver halide emulsion layer, and at least one antistatic layer adhered to at least one side of said polymeric film base, wherein (1) said silver halide emulsion layer comprises tabular silver halide grains having an average diameter to thickness ratio of at least 3:1, and (2) said antistatic layer comprises a colloidal vanadium oxide and a sulfopolyester and an adhesion-promoting amount of an epoxy-silane compound.

2. The silver halide radiographic element of claim 1 wherein the polymeric film base comprises a polyester film base.

3. The silver halide radiographic element of claim 2 wherein said polyester film base is tentered before the application of said antistatic layer.

4. The silver halide radiographic element of claim 1 wherein said colloidal vanadium oxide comprises whisker-shaped particles of vanadium oxide.

5. The silver halide radiographic element of claim 1 wherein said colloidal vanadium oxide comprises needle-shaped particles of vanadium oxide.

6. The silver halide radiographic element of claim 5, wherein said vanadium oxide particles show a high aspect ratio.

7. The silver halide radiographic element of claim 6 wherein said vanadium oxide particles show an aspect ratio higher than 10.

8. The silver halide radiographic element of claim 6 wherein said vanadium oxide particles show a width in the range of from 0.02 to 0.08 mm and a length lower than 5 mm.

9. The silver halide radiographic element of claim 1 wherein said colloidal vanadium oxide is present in an amount of at least 0.40 mg/m$^2$.

10. The silver halide radiographic element of claim 1 wherein the sulfopolyester comprises units represented by the formula:

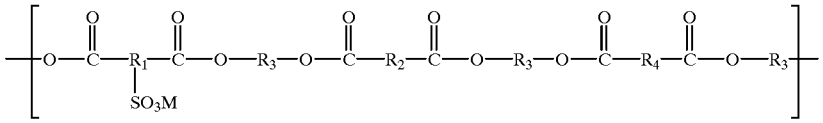

where

M represents an alkali metal cation or ammonium cation, $R_1$ represents a sulfosubstituted arylene or aliphatic group, $R_2$ represents an arylene group, $R_3$ represents an alkylene group, $R_4$ represents an alkylene group or cycloalkylene group.

11. The silver halide radiographic element of claim 1 wherein the weight ratio of sulfopolyester to vanadium oxide ranges from 30:1 to 800:1.

12. The silver halide radiographic element of claim 1 wherein the antistatic layer has a coating weight in the range of 10 mg/m$^2$ to 1 g/m$^2$.

13. The silver halide radiographic element of claim 1 wherein said antistatic layer is coated on only one side of said film base.

14. The silver halide radiographic element of claim 1 wherein said antistatic layer is coated on both sides of said film base.

15. The silver halide radiographic element of claim 13 wherein an auxiliary gelatin layer is adhered to said antistatic layer.

16. The silver halide radiographic element of claim 13 wherein said silver halide emulsion layer is on the same side of said film base as said antistatic layer.

17. The silver halide radiographic element of claim 13 wherein the silver halide emulsion layer is on the opposite side of said film base as said antistatic layer.

18. The silver halide radiographic element of claim 1 wherein an auxiliary gelatin layer is adhered to said antistatic layer.

19. The silver halide radiographic element of claim 1 wherein said epoxy-silane compound is represented by the formulae:

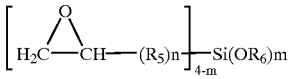

and

-continued

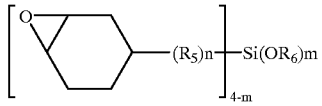

wherein:

$R_5$ is a divalent hydrocarbon radical of less than 20 carbon atoms, $R_6$ is hydrogen, an aliphatic hydrocarbon radical of less than 10 carbon atoms or an acyl radical of less than 10 carbon atoms, n is 0 or 1, and m is 1 to 3.

20. The silver halide radiographic element of claim 1 wherein said epoxy-silane compound is represented by the formulae:

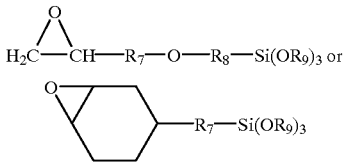

wherein:

$R_7$ and $R_8$ are independently alkylene groups of 1 to 4 carbon atoms, and $R_9$ is hydrogen or an alkyl group of 1 to 10 carbon atoms.

21. The silver halide radiographic element of claim 1 wherein said epoxy-silane compound is γ-glycydoxypropyltrimethoxysilane.

22. The silver halide radiographic element of claim 1 wherein said epoxy-silane compound is β-(3,4-epoxycyclohexyl)-ethyltrimethoxysilane.

23. The silver halide radiographic element of claim 1 wherein the weight ratio of epoxy-silane to sulfopolyester is in the range of 0.01 to 0.6.

24. The silver halide radiographic element of claim 1 wherein said epoxy-silane compound is partially or fully hydrolized.

25. The silver halide radiographic element of claim 1 wherein said epoxy-silane compound is a siloxane polymer or oligomer.

26. The silver halide radiographic element of claim 1 characterized in that the side comprising said antistatic layer shows a melting time lower than 10 minutes.

27. The silver halide radiographic element of claim 1, wherein said tabular silver halide grains have an average diameter to thickness ratio of 3:1 to 8:1.

28. The silver halide radiographic, element of claim 1, wherein said tabular silver halide grains have an average diameter ranging from about 0.3 to 5 $\mu$m.

29. The silver halide radiographic element of claim 1, wherein said tabular silver halide grains have an average thickness of 0.4 $\mu$m or less.

30. The silver halide radiographic element of claim 1, wherein not less than 50% of the silver halide grains are tabular silver halide grains having an average diameter to thickness ratio of at least 3:1.

31. The silver halide radiographic element of claim 1, wherein said silver halide grains are silver bromide or silver bromoiodide grains.

32. The silver halide radiographic element of claim 31, wherein said silver bromoiodide grains comprise an amount of from 0.5 to 1.5 mol % of iodide relative to the total halide content.

* * * * *